US005685031A

United States Patent [19]

Watkins et al.

[11] Patent Number: 5,685,031

[45] Date of Patent: Nov. 11, 1997

[54] THREE-PIECE PORTABLE SPA COVER

[75] Inventors: Jeffrey King Watkins, Rancho Santa Fe; Walter Richard Cumiskey, Vista, both of Calif.

[73] Assignee: Watkins Manufacturing Corporation, Vista, Calif.

[21] Appl. No.: 643,229

[22] Filed: May 2, 1996

Related U.S. Application Data

[63] Continuation of Ser. No. 353,082, Dec. 9, 1994, abandoned, which is a continuation-in-part of Ser. No. 205,609, Mar. 3, 1993, Pat. No. 5,398,350.

[51] Int. Cl.[6] ..... E04H 4/08

[52] U.S. Cl. ..... 4/498; 220/333

[58] Field of Search ..... 4/498, 503, 506, 4/580; 220/333, 334, 908

[56] References Cited

U.S. PATENT DOCUMENTS

| | | | |
|---|---|---|---|
| 3,018,915 | 1/1962 | Larson | 220/334 X |
| 3,072,920 | 1/1963 | Yellott | 4/498 X |
| 4,213,539 | 7/1980 | Reuter | 220/333 |
| 4,279,357 | 7/1981 | Robinson | 220/908 X |
| 4,391,386 | 7/1983 | Moret | 220/333 X |
| 4,422,192 | 12/1983 | Jacobs | 4/498 |
| 4,577,352 | 3/1986 | Gautheron | 4/498 X |
| 4,749,606 | 6/1988 | Moore | 4/498 X |
| 4,853,985 | 8/1989 | Perry | 4/498 |
| 4,857,374 | 8/1989 | Perry | 4/498 X |
| 5,086,525 | 2/1992 | Christopher | 4/498 |
| 5,248,057 | 9/1993 | Taylor | 220/333 |
| 5,398,350 | 3/1995 | Watkins et al. | 4/498 |

OTHER PUBLICATIONS

Flyer of Hot Spring Portable Spas re "The Tip Top" Spa Cover (1991), 2 pages.

Brochure of the Centech Corporation entitled, "Tub Cap" (no date), 4 pages.

Brochure of Softub entitled, "Series by Softub" (Jun. 1993) 7 pages.

Flyer of Softub re "Softop" (no date), 1 page.

Brochure of Softcare entitled, "Softcare Essentials" (1995), 8 pages.

*Primary Examiner*—Robert M. Fetsuga

*Attorney, Agent, or Firm*—Price, Gess & Ubell

[57] ABSTRACT

A portable spa cover having three rigidly molded, interlocking pieces including two mirror image end pieces and a center piece and designed to conform with the contour of the rim of a spa. Each cover piece has an undersurface and outer surface with a plurality of radial support ribs being formed in the undersurface to provide strength and rigidity. Elongated, tapered male and female hinge members are integrally molded as part of the respective end pieces and center piece and permit the cover pieces to be engaged and disengaged from one another when at an angle with respect to one another, while remaining firmly locked together when the pieces all lie horizontally. The horizontal engagement is further facilitated by resilient fingers which extend out from the male projection at intervals along the cover edge and provide a resiliently biased interlocking mechanism.

19 Claims, 11 Drawing Sheets

THREE-PIECE PORTABLE SPA COVER

This is a continuation of application Ser. No. 08/353,082, filed on Dec. 9, 1994, abandoned, which is a continuation-in-part application of U.S. Ser. No. 08/205,609, filed on Mar. 3, 1993, and issued as U.S. Pat. No. 5,398,350 on Mar. 21, 1995.

BACKGROUND OF THE INVENTION

1. Field of the Invention

The subject invention relates to spas, whirlpools, and the like and, more particularly, to improved cover apparatus for use with portable spas.

2. Description of Related Art

Portable spas are generally known in the prior art and have become increasingly popular as a source of relaxation and physical therapy. Their structure generally includes a spa shell or "tub" fabricated of various materials such as fiberglass/acrylic or various thermoplastics, a layer of thermal insulation placed against the shell, and a wooden support structure, often employing a 2×4 frame. In many cases, the exterior of the spa is a continuation of the shell. In some cases, decorative redwood patterns have been applied to serve as the exterior sidewalls or "skirts" of free-standing units. Decorative tile work has also been variously used in the interior and exterior design of portable spas.

In order to retain heat and reduce evaporation, portable spas have been fitted with insulating covers. The most commonly used cover is made of cut styrofoam halves surrounded by a sewn vinyl covering and permanently hinged together. This structure provides a flat cover, which is simply slid over the top of the spa when the spa is not in use. Another known spa cover for use with a so-called "soft core" spa is formed of one-piece polyethylene foam with a hand-sewn cover and fits into the spa like a cork. Other covers have employed foam cores with more resilient rigid covering materials and have employed various spring-biased hinged mechanisms for raising and lowering because of their considerable weight.

To meet industry safety standards such as ASTM F1346-91, spa covers must meet static load, deflection, and surface drainage standards. Under ASTM F1346-91, a spa cover must support a weight of 485 pounds. A deflection test must be met to ensure that if a child under five falls on the cover, he cannot slip through any openings. The surface drainage standard ensures that the cover will not retain enough water to risk drowning of a small child.

Spa covers of the prior art in general suffer from a number of drawbacks. The conventional spa covers are labor intensive to manufacture, cumbersome to use, and have a notoriously short life span in the face of hot chlorinated water, sunlight, and the wear and tear of use. Many of the designs, such as the soft core "cork," cannot meet industry safety standards.

OBJECTS AND SUMMARY OF THE INVENTION

It is therefore an object of the invention to improve covers used in connection with portable spas and similar pool structures;

It is another object to increase the life of covers used in conjunction with spas;

It is another object to improve the ease of use of spa covers; and

It is another object to provide a spa cover design which is relatively lightweight and easy to use and which can meet industry safety standards;

According to the invention, an improved portable spa cover integrating several novel aspects into the overall design is provided. These aspects include rigidly molded, interlocking cover sections, adapted to rest on the upper rim of the spa. The cover sections each preferably include an outer surface and an inner surface with a plurality of support ribs being provided to add strength and rigidity. Hinge means are provided which prevents disengagement when the cover sections are lying horizontal and which enable the cover sections to be engaged and disengaged when one of them is horizontally disposed and the other is at an acute angle to the horizontal. According to another aspect of the invention, the hinge means includes finger means which bias the cover halves together and further bolster and secure their horizontal relation. The inventive aspects just discussed are particularly disclosed in a three-piece cover embodiment wherein first and second end pieces are removably hinged to a center piece.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide readily manufacturable and particularly useful portable spa improvements.

Figure 1:
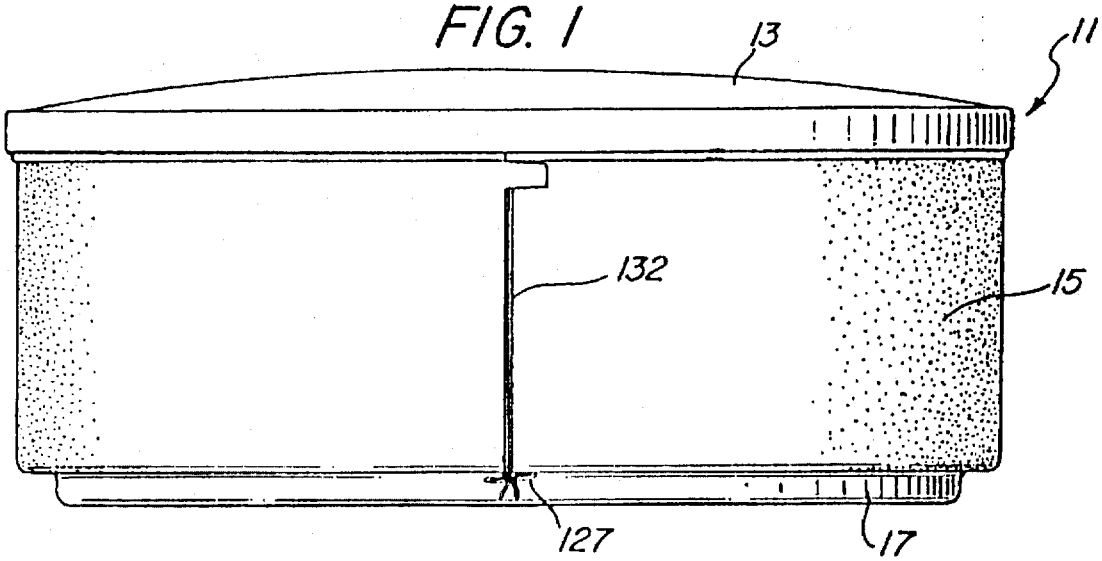
FIG. 1 is a side elevational view of a spa wherein the preferred embodiment may find application.

FIG. 1 illustrates a spa 11 whereupon is mounted a cover 13 according to the preferred embodiment. The spa 11 further includes a decorative, interchangeable side skirt 15 and a bottom pan 17. The skirt 15 includes a zipper 132 and is removable and replaceable by skirts of, for example, different colors.

Figure 2:
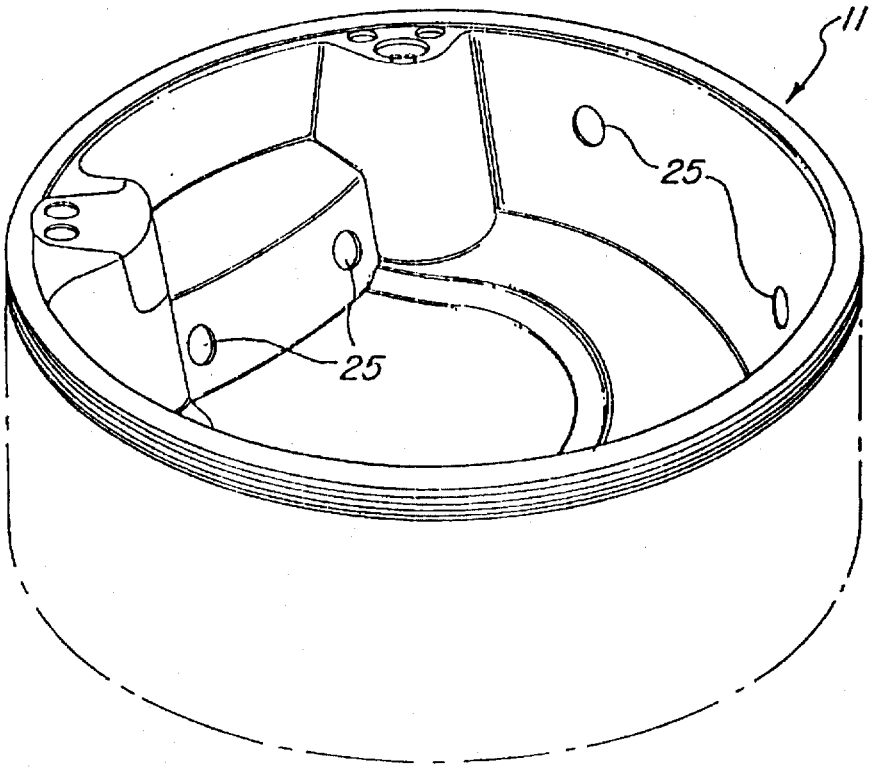
FIG. 2 is a perspective view of a spa according to FIG. 1 with the cover removed.

FIG. 2 shows a typical interior configuration of the spa 11, including jet openings 25 and seating areas. The particular interior detail is, of course, variable, as will be appreciated by those skilled in the art.

Figure 3:
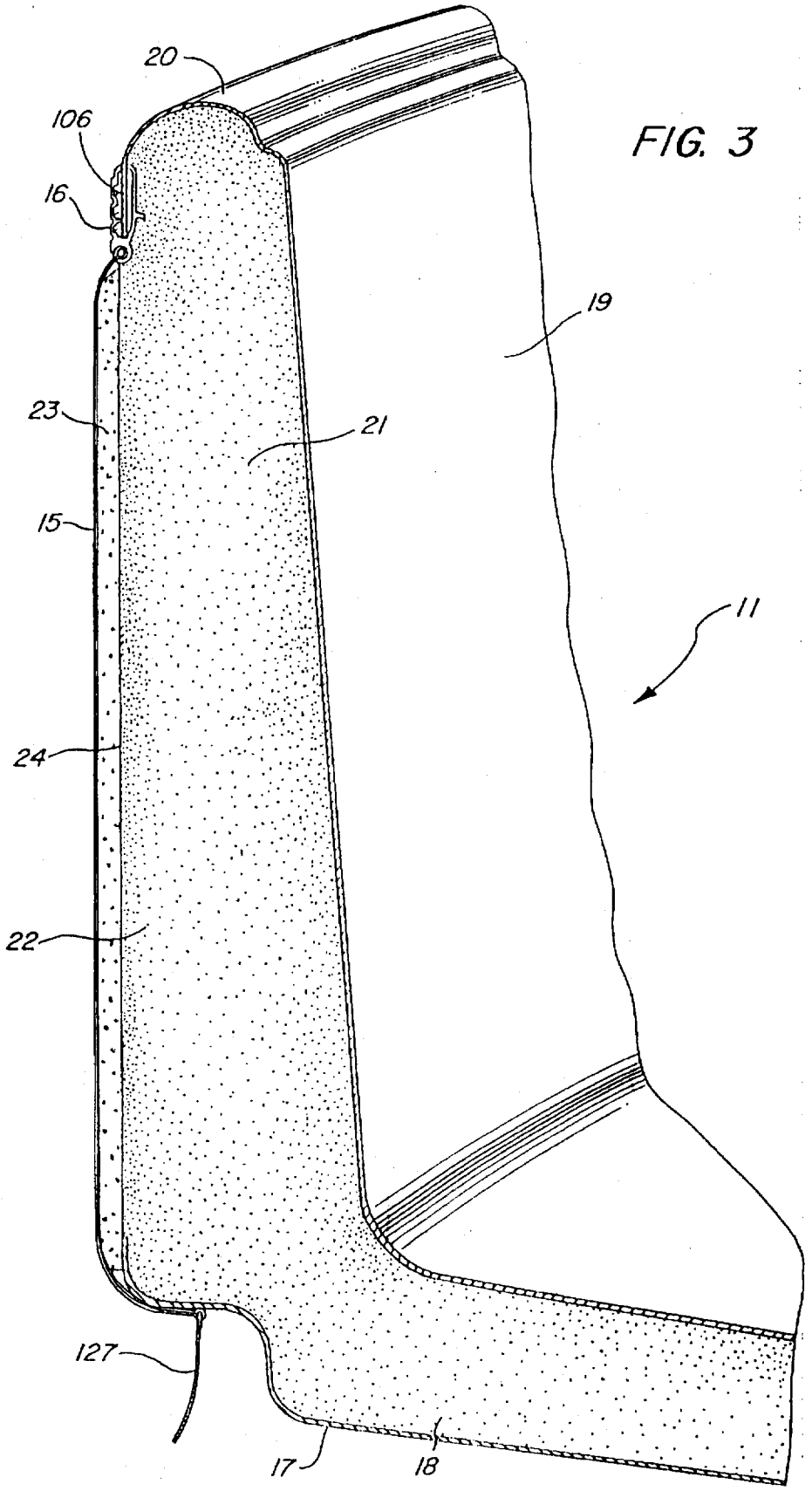
FIG. 3 is a partial side sectional view of the spa of FIG. 1.

As shown in FIG. 3, the spa interior is provided by a molded shell 19, which may be molded from fiberglass, acrylic, polypropylene, or other materials. The shell 19 includes a crowned upper rim 20 having a depending vertical edge or lip 106. Adjacent the shell 19 is a layer of rigid foam insulation 21 which defines the exterior contour of the spa 11, providing a bottom surface 18 and a side surface 22. The foam insulation 21 is preferably a rigid, two-pound density, closed cell, polyurethane foam. The bottom surface 18 is contoured to conform to the interior surface shape of the bottom pan 17. The bottom pan 17 itself is waterproof and is glued to the rigid foam insulation 21 in order to provide a sealed, water impervious surface. The interchangeable skirt 15 is positioned adjacent the side surface 22 and includes interior foam padding or batting 23 and a backing layer of cloth material 24. The upper edge of the interchangeable skirt 15 inserts within the lower edge of an extrusion 16, which attaches to the depending vertical edge 106 of the spa rim 20.

Figure 4:
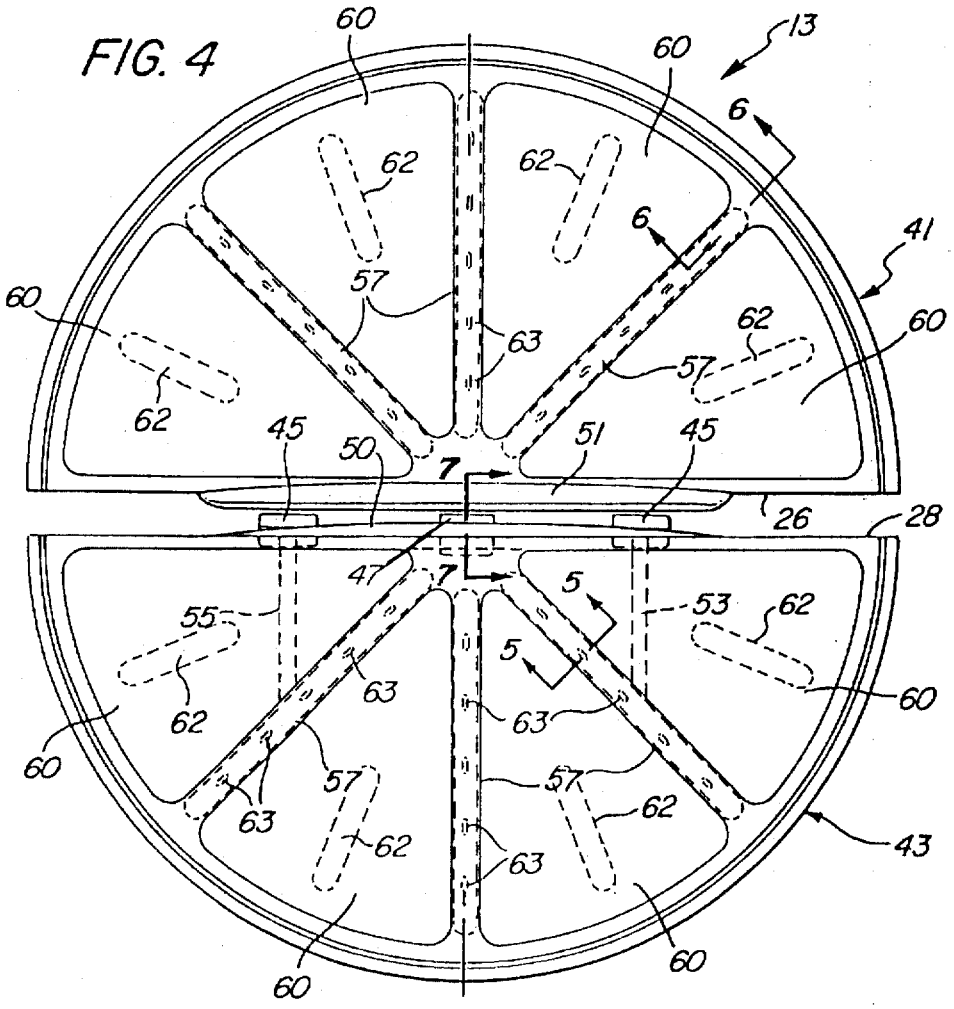
FIG. 4 is a top view of a two-piece spa cover embodiment.

The top cover 13 is shown in more detail in FIGS. 4–11. The top cover 13 shown in FIG. 4 is generally circular and includes a female half 41 and a male half 43. These halves 41, 43 are adapted to abut one another along corresponding edges 26, 28. Each half 41, 43 further includes three identically-formed ribs 57, which separate or define four pie-shaped sections 60. Each cover half 41, 43 is a unitary part, preferably rotationally molded plastic, although injection molding might be used.

Figure 5:
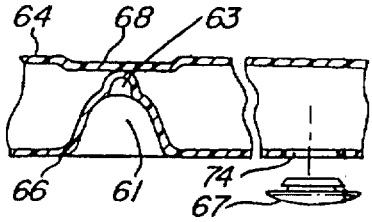
FIG. 5 is a sectional view taken at 5—5 of FIG. 4.

As shown in FIG. 5, each rib 57 is formed by molding the bottom lower surface 66 of the particular cover half 41, 43 to conform to a bell-shaped cross-section, thereby forming a bell-shaped channel or impression 61. At regular intervals, the bell-shaped channel 61 is further provided with domes 63, which extend to meet a recess 68 in the upper surface 64 of a respective cover half 41, 43. Five such domes 63, equally spaced from one another, may be provided in each rib 57. This overall structure provides strength and rigidity to the respective cover halves 41, 43.

Additional intermediate channel areas 62 are also preferably provided to add additional strength to the structure. These channel areas may be substantially identical in cross-section to that of the ribs 57 shown in FIG 5. Two domes 63 are preferably provided in the intermediate channels 62.

As further illustrated in FIG. 5, openings 74 are provided in the lower surface 66 of each cover half 41, 43. These openings 74 are filled with foam beads such as polystyrene beads, and then plugs 67 are inserted. The beads provide insulation to the cover 13. Such beads could also provide additional structural support if they were molded into a core at the end of the rotational mold cycle.

In the foregoing manner, the cover 13 is provided with an inner skin 66 and outer skin 64 spaced apart from one another, for example, by a mean spacing of 70–80 millimeters, except at a number of selected areas where the two surfaces are brought adjacent to one another by the dome structures 63, thereby facilitating a rotational molding process. A sealed interior providing desirable insulation characteristics is additionally achieved.

Figure 6:
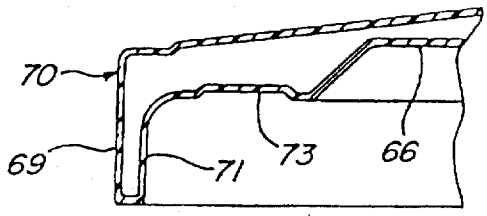
FIG. 6 is a sectional view taken at 6—6 of FIG. 4.

As shown in FIG. 6, the top surface of each cover section 41, 43 angles gently downward to an outer rim 70, which includes an outer vertical wall 69 and an inner vertical wall 71. The inner vertical wall 71 curves through a 90-degree radius to a slightly recessed channel 73 molded to meet and rest on the rim 20 of the spa 11 in order to provide an adequate and effective seal therewith. If desired, this recessed area 73 may be provided with a strip of insulating material to provide a seal between the rim 20 and the cover 13. The rim 70 thus provides a depending skirt which surrounds the outer circumference of the spa 11 and retains the cover 13 in place on the spa 11.

The cover halves 41, 43 feature an integrally molded interlocking hinge mechanism provided by an elongated, tapered female hinge projection 51, an elongated, tapered male hinge projection 50, a central finger extension 47, and first and second side finger extensions 45. Molded indentations 53, 55 (FIG. 4) of rectangular cross-section may be provided to strengthen the area behind the side finger extensions 45.

Figure 7:
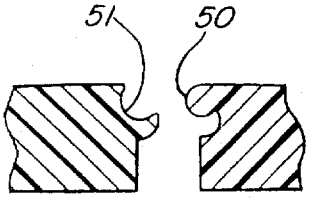
FIG. 7 is a sectional view taken at 7—7 of FIG. 4.
Figures 8, 9, 10:
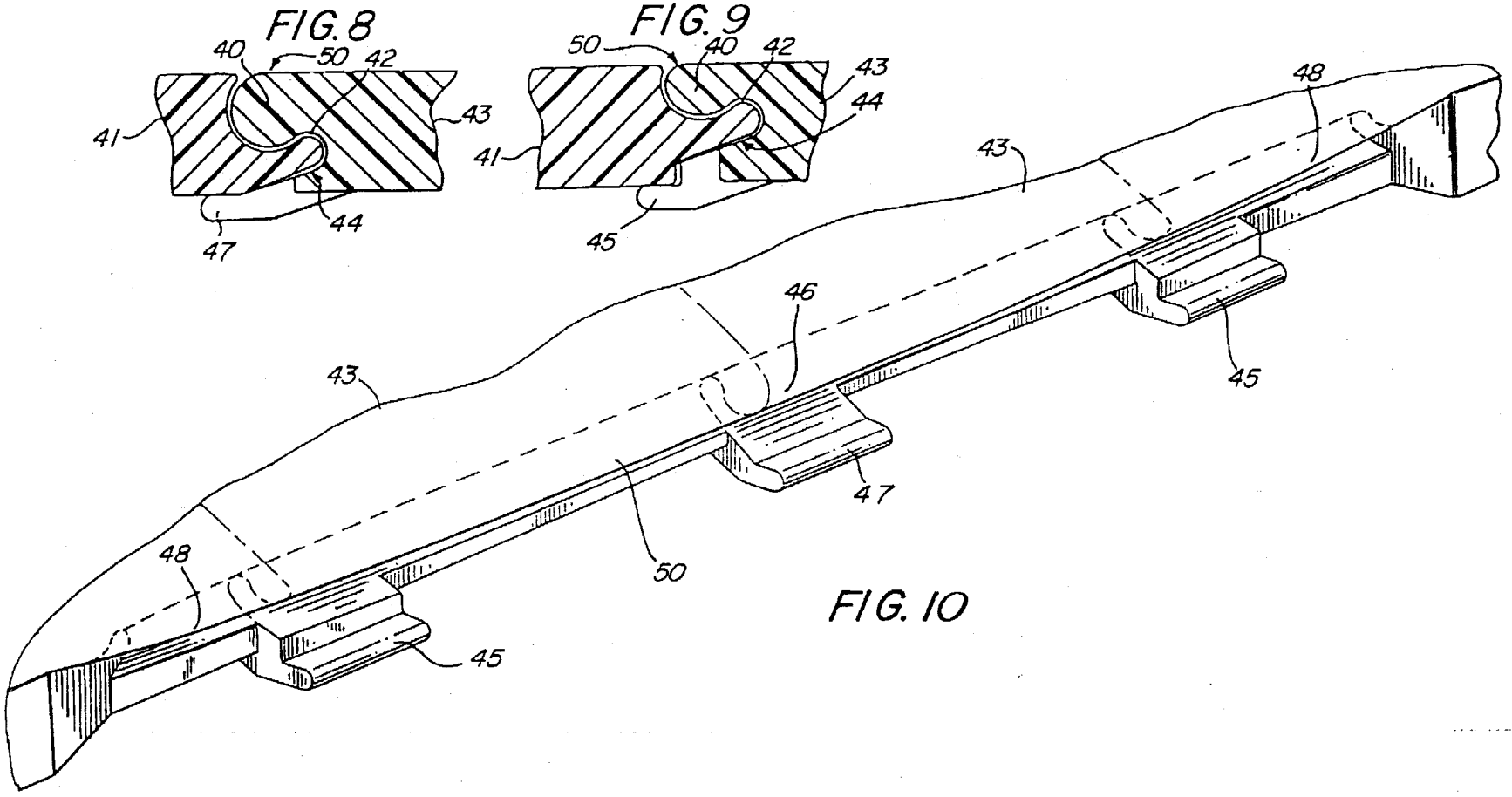
FIG. 8 is a detail illustrating the hinge structure of the two-piece cover embodiment.
FIG. 9 is a detail further illustrating the hinge structure of the two-piece embodiment.
FIG. 10 is a partial, cutaway perspective view of a first cover half according to the two-piece embodiment.
Figure 11:
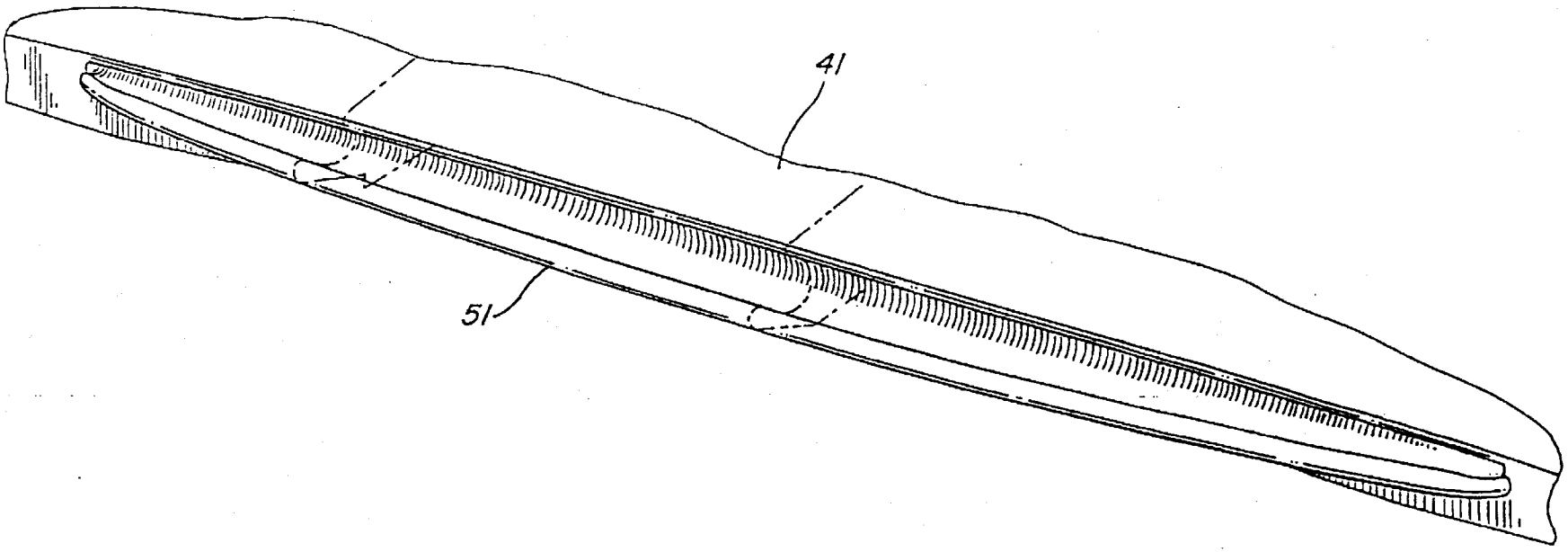
FIG. 11 is a partial, cutaway perspective view of a second cover half.

FIG. 7 generally illustrates the cross-sectional mating structure of the elongated, tapered projections 51, 50 at the center of the two halves 41, 43, while omitting the finger detail. FIGS. 8 and 9 illustrate in detail the hinge cross-section at the location of the central finger extension 47 and the side finger extensions 45, respectively. As shown, the male projection 50 generally includes a bulbous portion 40 undercut to form a recessed receptacle portion 42, which curves into a descending angled floor portion 44. As illustrated in FIGS. 8–11, this cross-section continuously and symmetrically narrows from the center 46 of hinge projection 50 toward each end 48 thereof, resulting in a profile which generally recedes away from a relatively prominent bulbous crown 46 at the center 46 toward the ends 48.

The female projection 51 is correspondingly contoured to conform to the varying cross-section of the receptacle 42 and the descending floor portion 44 presented by the male projection 51. The resulting interlocking structure cannot be pulled apart when both cover halves 41, 43 are horizontally disposed, but can be pulled apart when one half is elevated to an acute angle with the horizontal, the angle being determined by the geometry of the interlocking structure, particularly the upsweep of receptacle 42 and the clamping action between bulbous portion 40 and the finger extensions 45, 47.

Thus, the two cover halves 41, 43, when lying on a flat plane, e.g., when their inner surfaces 73 are supported by the spa rim 20, are restrained from being pulled apart in a horizontal direction by the interaction of the hinge projections 50, 51 and the fingers 45, 47. Engagement and release of these mated, hinged parts is achieved by raising one of the cover halves 41, 43 to approximately 40 degrees above horizontal. At that point, the hinged halves 41, 43 release and allow separation for easier removal, handling, and storage.

The fingers 45, 47 exhibit resilience and are further preferably disposed to provide an interference fit or bias; that is, the fingers 45, 47 are depressed slightly downward against their biased position as the cover halves 41, 43 interlock, and therefore tend to hold the cover halves 41, 43 in interlocking relationship to create a tight fit. This action is particularly desirable in the face of molding tolerances. The fingers 45, 47 also prevent the engaged cover halves 41, 43 from tending to bow in or out, and thus serve to preserve the horizontal interlocking relationship of the cover halves 41, 43.

The natural locking tendency of the two cover shapes 41, 43 prevents horizontal separation and helps maintain a weathertight seal for the spa. The natural locking tendency of the two shapes 41, 43 further discourages unwanted or unauthorized entry of persons into the spa water, when used in conjunction with external lockdown mechanisms (not shown), which secure the cover halves 41, 43 to the spa proper. Thermal efficiency of the complete package is promoted by reducing loss of heat from the spa water that might occur with a nonjoined assembly of cover halves. Such efficiency may be further promoted in some configurations by placement of spongy insulation and sealing material along the portions of the surfaces of the abutting edges 26, 28 which lie adjacent the elongated hinge projections 50, 51. The molded, two-piece cover 13 is also relatively lightweight, lasts twice as long as conventional foam-based lids, can be fabricated to meet ASTM safety standards, and provides other advantages noted above.

It may be noted that the structural advantages of the cover 13 can be adapted to various other cover shapes, for example square or rectangular. In such case, support ribs may run in directions other than radially and the same or similar hinge mechanism may be used. One such other cover shape is the three-part rectangular spa cover embodiment 201 shown in more detail in FIGS. 12–21.

Figure 12:
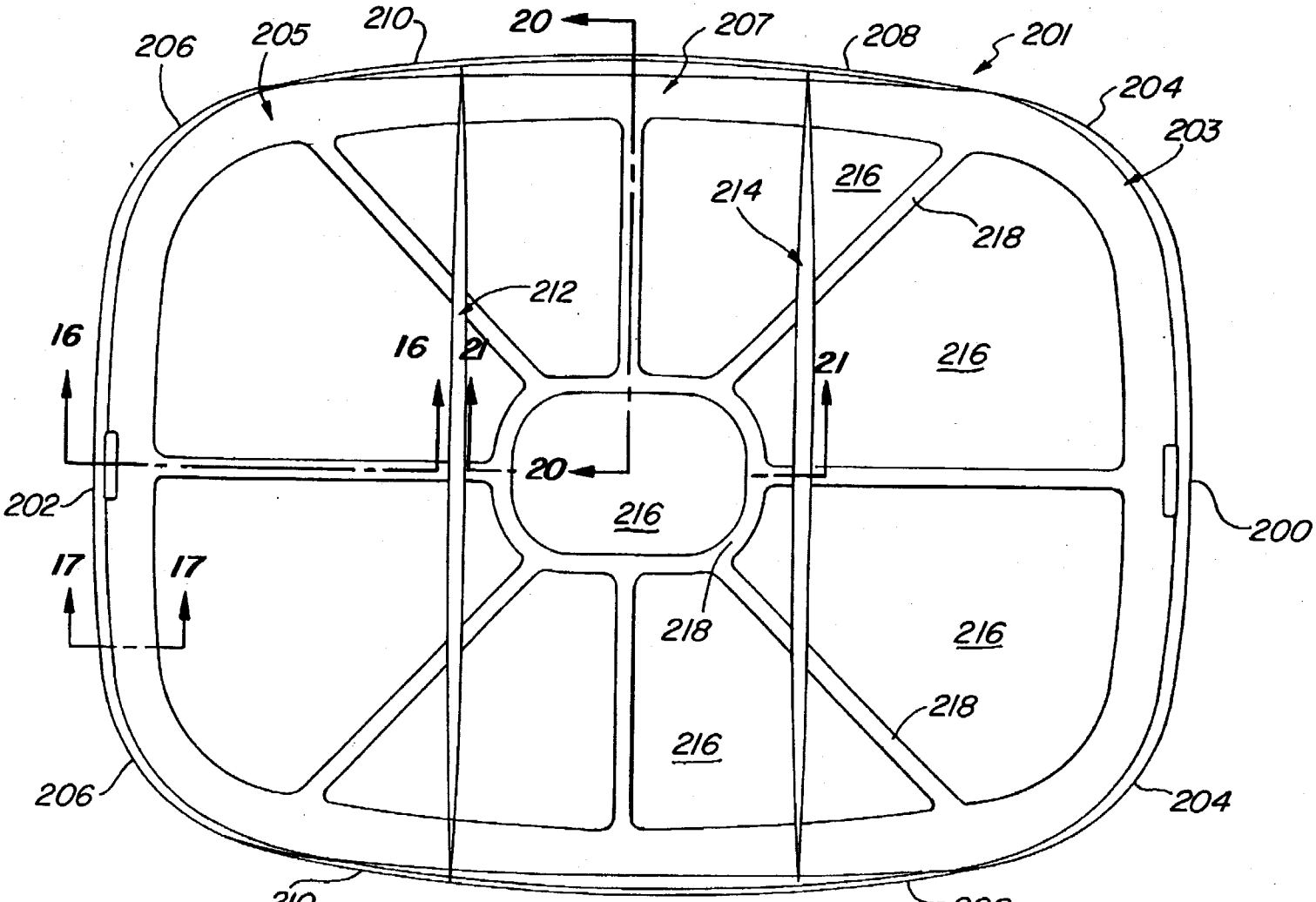
FIG. 12 is a top view of a three-piece, generally rectangular spa cover embodiment.

The spa cover 201 shown in FIG. 12 includes generally rectangular right and left end pieces 203, 205 and a generally rectangular middle piece 207. The right and left end pieces 203, 205 are adapted to abut the middle piece 207 along corresponding edges 212, 214. In the preferred embodiment illustrated, the right end piece 203 and left end piece 205 each have a generally straight, flat end 200, 202 which is radiused or arced through respective corners 204, 206 into slightly obtusely angled respective sides 208, 210. The sides 208, 210 symmetrically and gently expand apart from one another and terminate at the inner edge 212, 214 of each respective side piece 203, 205. In the preferred embodiment, the end pieces 203, 205 are mirror images of one another and, thus, essentially identical in various structural aspects. As noted, the middle piece 207 is generally rectangular in appearance with sides arced slightly to meet the sides 208, 210 of the respective end pieces 203, 205.

Each cover piece or section 203, 205, 207 is a unitary part, preferably rotationally molded plastic, although injection molding might be used. The cover top shown in FIG. 12 is shown with detail areas, e.g. 216, raised slightly above channel areas, e.g. 218 by, e.g., 125-inch, for decorative purposes.

Figure 13:
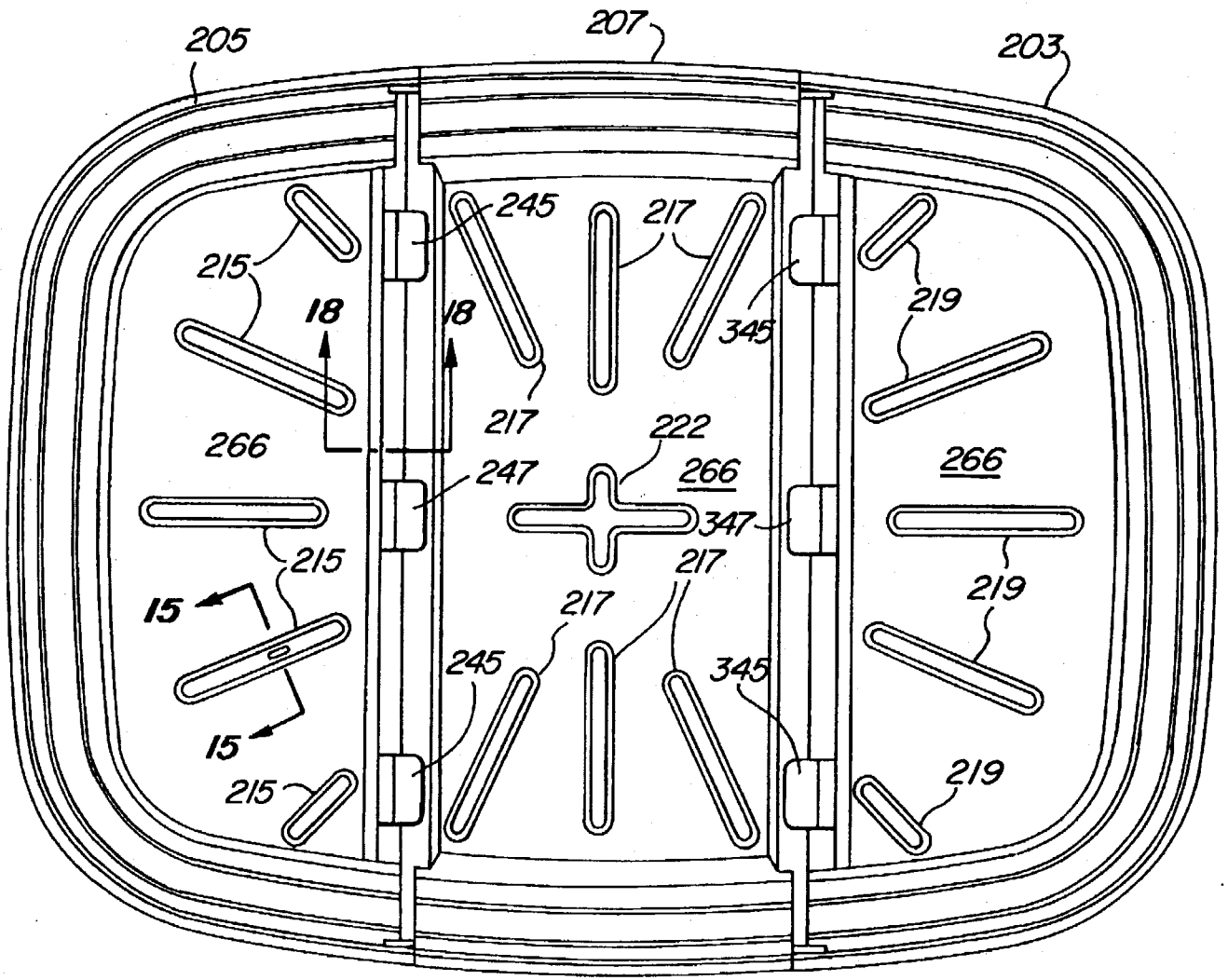
FIG. 13 is a bottom view of the cover of FIG. 12.
Figure 14:
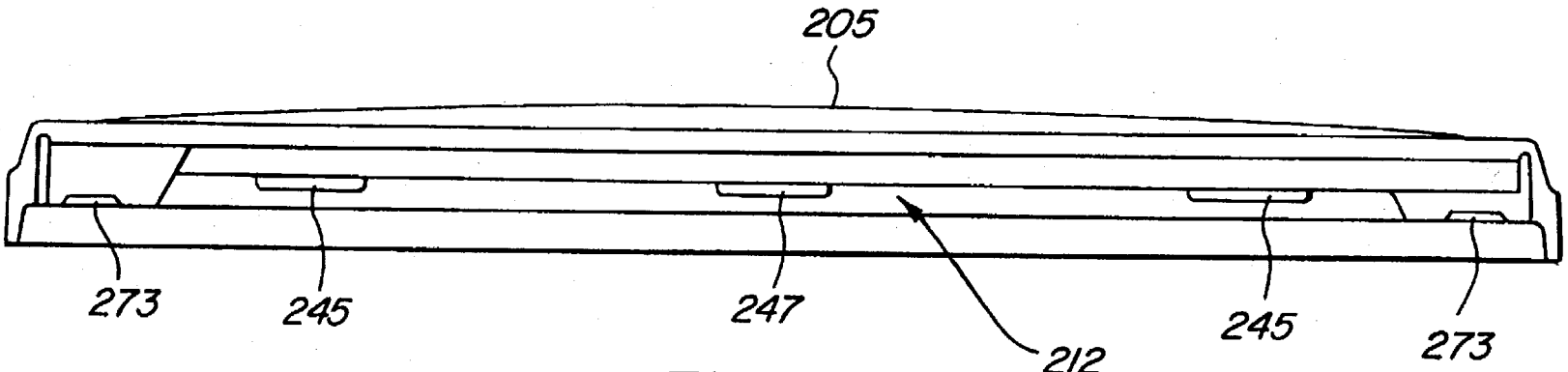
FIG. 14 is an end view depicting the inner end of an end cover piece of the cover of FIG. 12.
Figure 15:
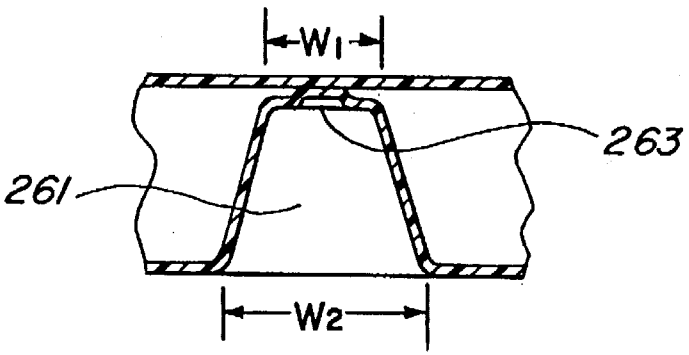
FIG. 15 is a partial sectional view taken at 15—15 of FIG. 13.

Each cover piece 203, 205, 207 further includes generally radially distributed support ribs 215, 217, 219 (FIG. 13). The middle piece 205 also includes a cross-shaped center support rib 221. Each rib 215, 217, 219, 221 is formed by molding the respective bottom lower surface 266, 267, 268 of the respective cover piece 205, 207, 203 to conform to a bell-shaped cross-section, thereby forming a plurality of bell-shaped channels or impressions 261, as shown in FIG. 15. Such channels 261 may have a bottom width $W_1$ of two inches symmetrically narrowing to a width $W_2$ of, e.g., 1.1 inches. At selected intervals, each bell-shaped channel 261 is further provided with one or more domes 263, which extend to meet the upper surface 264 of a respective cover piece 203, 205, 207. The domes 263 are preferably spaced apart by approximately five inches, the number thus varying with the length of the rib. This overall structure provides strength and rigidity to the respective cover pieces 203, 205, 207.

In the foregoing manner, the cover pieces 203, 205, 207 are each provided with an inner skin 266 and an outer skin 264 spaced apart from one another, for example, by a mean spacing of 70–80 millimeters, except at a number of selected areas where the two surfaces are brought adjacent to one another by the dome structures 263, thereby facilitating a rotational molding process. As with the cover structure illustrated in FIGS. 4–11, openings may be provided in the lower surface 266 of each cover piece 203, 205, 207 and filled with foam beads such as polystyrene beads, and then plugged. A sealed interior providing desirable insulation characteristics is additionally achieved.

Figure 17:
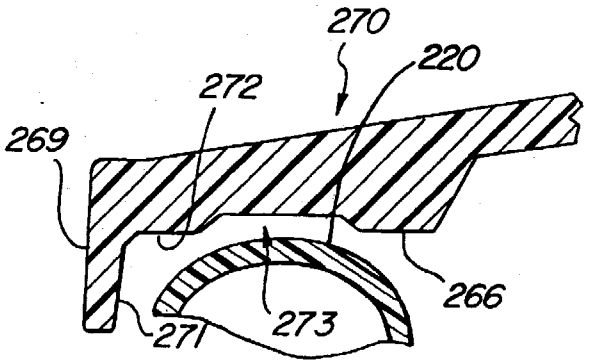
FIG. 17 is a sectional view taken at 17—17 of FIG. 12.
Figure 19:
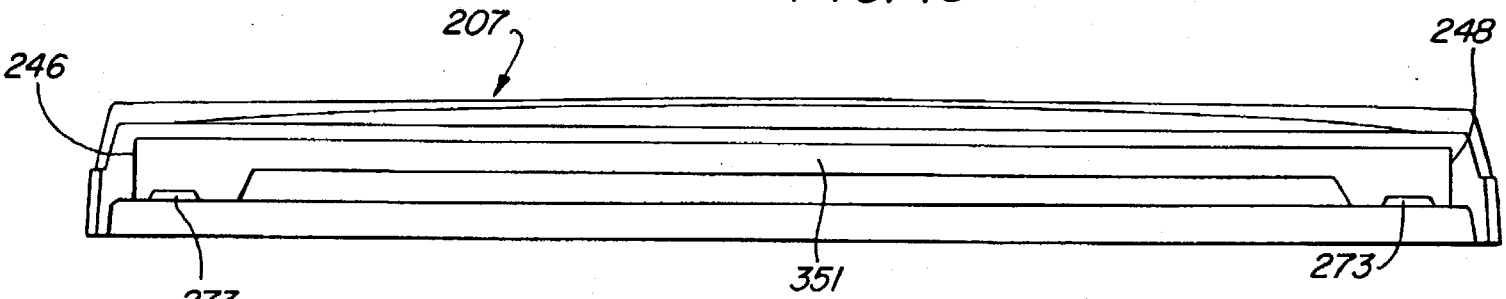
FIG. 19 is an end view of the center piece of the cover of FIG. 12.
Figure 20:
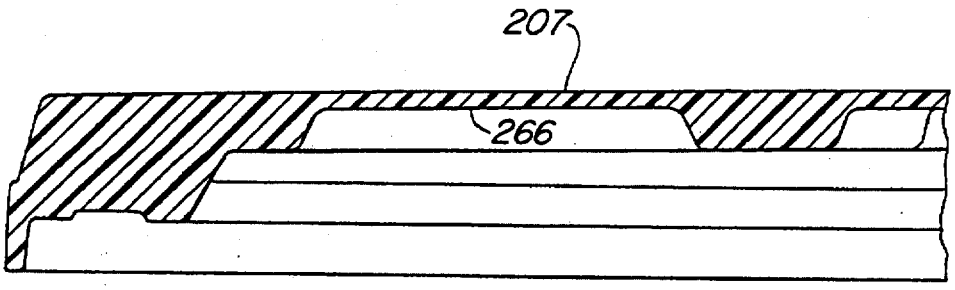
FIG. 20 is a sectional view of the cover center piece taken at 20—20 of FIG. 12.

As shown in FIG. 17, the top surface of each cover end piece 203, 205 angles gently downward to an outer rim 270, which includes an outer wall 269 and an inner wall 271, each at a slight angle to the vertical. The inner wall 271 transitions through a first horizontal surface 272 to a slightly recessed channel 273 molded to meet and rest on the rim 220 of a cooperating spa structure in order to provide an adequate and effective seal therewith. The inner wall 271 is thus displaced, e.g., by about 0.75-inch from the side of the spa to accommodate tolerances and operation of a built-in gutter as hereafter described. If desired, this recessed area 273 may be provided with a strip of insulating material to provide a seal between the spa rim 20 and the cover 201. The rim 270 thus provides a depending skirt which surrounds the outer circumference of the spa and retains the cover 201 in place on the spa.

Figure 16:
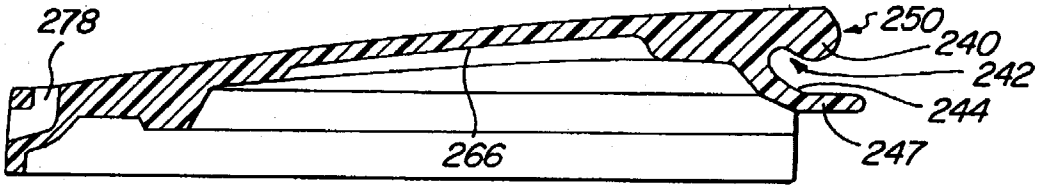
FIG. 16 is a sectional view of an end cover piece taken generally at 16—16 of FIG. 12.
Figure 18:
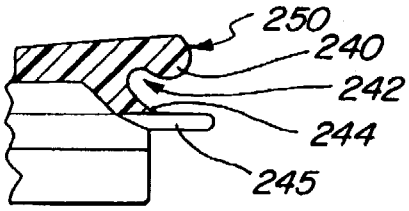
FIG. 18 is a sectional view taken at 18—18 of FIG. 13.
Figure 21:
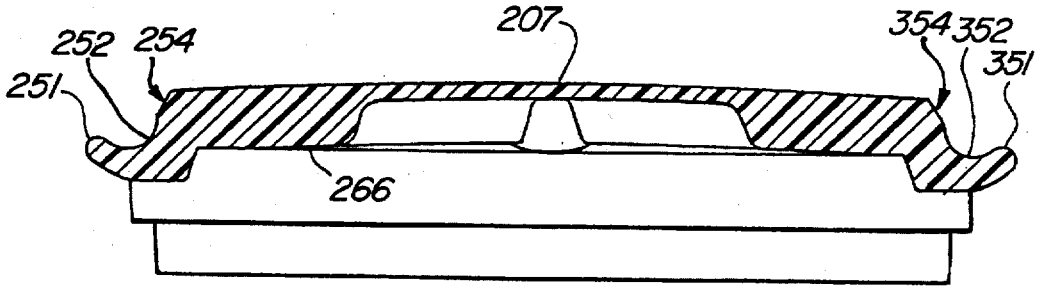
FIG. 21 is a sectional view of the cover center piece taken at 21—21 of FIG. 12.

As particularly shown in FIGS. 16, 18, and 21, the cover pieces 203, 205, 207 feature an integrally molded interlocking hinge mechanism provided by first elongated male hinge projections, e.g. 250, on the respective inner edge 214, 212 of each end piece 203, 205 and respective mating elongated female hinge projections 251, 351 on respective edges 254, 354 of the middle cover piece 207. As part of the hinge mechanism, each respective inner edge 214, 212 further includes a central finger extension 247, 347 and first and second side finger extensions 245 (FIG. 13), 345. As shown in FIG. 16, each end piece preferably includes an integrally formed handle opening 278.

Figure 22:
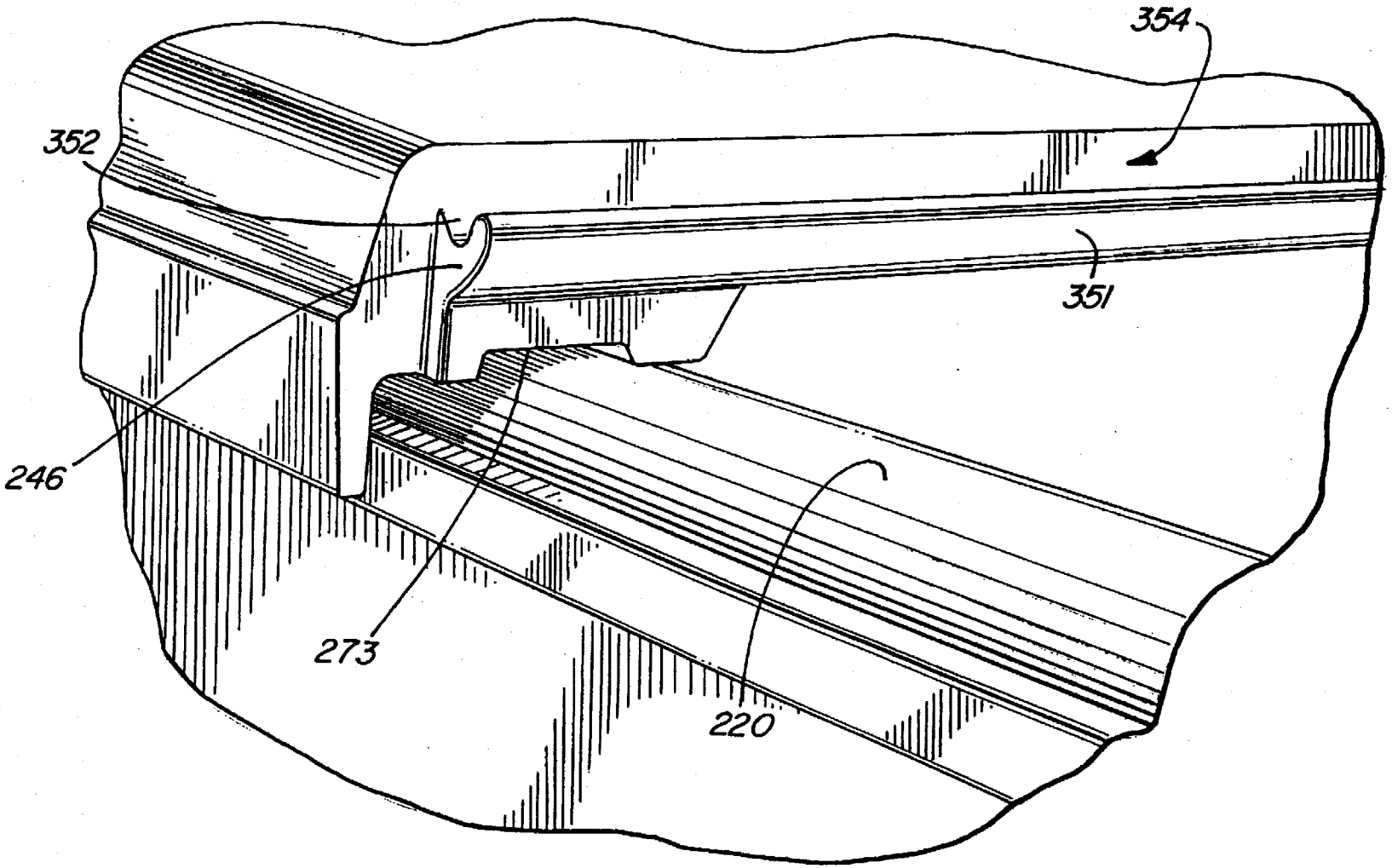
FIG. 22 is a perspective view illustrating the center cover piece of the cover of FIG. 12 mounted on a cooperating spa rim.

FIGS. 16, 18, and 21 generally illustrate the cross-sectional mating structure of the male and female hinge projections 251, 351, 250. As shown, the male projection 250 generally includes a bulbous portion 240 undercut to form a recessed receptacle portion 242, which curves into a descending angled floor portion 244. This cross-section is continuously maintained from the center of the male hinge projection 250 to each end thereof. Each end 246, 248 of the female hinge projection 351 is further located to extend beyond or overhang the midpoint of the spa rim 220, as particularly shown in FIG. 22. Through such positioning, the troughs 252, 352 provided by the female hinge projections 251, 351 are arranged to serve as gutters to conduct water incident on the top of the lid outside of the spa pool.

The female projection 251 is correspondingly contoured to conform to the cross-section of the receptacle 242 and the descending floor portion 244 presented by the male projection 250. The resulting interlocking structure operates like the embodiment shown in FIGS. 4–11. Thus, the interlocked cover pieces 203, 205, 207 cannot be pulled apart when the mated pieces 203, 205, 207 are horizontally disposed, but can be pulled apart when either end cover piece 203, 205 has its outer end 200, 202 elevated to an acute angle with the horizontal, the angle being determined by the geometry of the interlocking structure, particularly the upsweep of receptacle 242 and the clamping action between bulbous portion 240 and the finger extensions, e.g., 245, 247.

As with the embodiment of FIGS. 4–11, the fingers 245, 247; 345, 347 exhibit resilience and are further preferably disposed to provide an interference fit or bias; that is, the fingers 245, 247; 345, 347 are depressed slightly downward against their biased position as the mating cover sections interlock, and therefore tend to hold the cover sections 203, 205, 207 in interlocking relationship to create a tight fit and prevent the engaged cover sections 203, 205, 207 from tending to bow in or out, thus serving to preserve the horizontal interlocking relationship of the cover sections. In general, the three-piece cover of FIGS. 12–21 enjoys all the advantages of the two-piece embodiment of FIGS. 4–11.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Cover apparatus comprising:

a first molded cover section having a first inner edge;

a second molded cover section having a second inner edge;

a third molded cover section means having first and second edges for manual placement on and off of an apparatus to be covered; and hinge means for pivotally interlocking said first inner edge with said first edge and said second inner edge with said second edge to form a removable three-piece cover having a periphery adapted to seat on a rim of the apparatus to be covered and for preventing horizontal disengagement of said first and second sections from said third section while permitting disengagement of either of said first and second sections from said third section when one of said first and second sections is raised to an acute angle with the horizontal, while said third section remains horizontal.

2. The cover of claim 1 wherein said first, second, and third sections are generally rectangular in shape.

3. The cover of claim 2 wherein said first, second, and third sections each have a plurality of support ribs molded therein.

4. The cover of claim 1 wherein said first and second sections each include an upper surface and a lower surface and a plurality of ribs defined by a bell-shaped contour in said lower surface.

5. The cover of claim 4 wherein each said bell-shaped contour includes a plurality of dome-shaped upward contours therein.

6. The cover of claim 5 wherein said first, second, and third sections provide a continuous outer rim having a downwardly-projecting vertical inner wall leading to indentation means for resting on said rim.

7. The cover of claim 1 wherein said first inner edge includes a male hinge projection, a central finger, and first and second side fingers, and wherein said first edge of said third molded cover section means includes female hinge means for interlocking with said male hinge projection and said first and second side fingers.

8. The cover of claim 7 wherein said central finger and first and second side fingers press-fittingly engage said first edge.

9. The cover of claim 1 wherein said hinge means comprises a first hinge structure and a second hinge structure, each of said first and second hinge structures comprising:

a male projection having, in cross-section, a bulbous portion undercut to form a recessed receptacle curving into a descending angled floor portion; and a female projection contoured to conform to the shape of said bulbous portion and to extend into and conform to the contour of said recessed receptacle and angled floor portion.

10. The cover of claim 1 wherein said hinge means further exerts a biasing force tending to hold the first, second, and third sections engaged.

11. Cover apparatus comprising first, second, and third cover sections, the first and second cover sections adapted to at least abut against one another along a first pair of corresponding edges and the second and third sections adapted to at least abut each other along a second pair of corresponding edges, to form a cover having a periphery adapted to seat on a rim of an apparatus to be covered, each section being formed of molded plastic and having an inner skin substantially spaced apart from an outer skin with the exception of a plurality of intermediate zones where the inner skin is formed with impressions which terminate in contact with the outer skin, and wherein the impressions comprise elongated ribs, the inner and outer skins contacting one another at at least one interval along each rib.

12. The cover apparatus of claim 11 wherein the depressions comprise radially extending ribs, the inner and outer skins contacting one another at intervals along each rib.

13. The cover apparatus of claim 12 wherein the abutting edges incorporate opposingly disposed projection means by which one cover section can be approached to abut the other cover section at an angle extending upward and away therefrom and, with lowering, engage the projection means with one another.

14. Cover apparatus comprising first, second, and third generally rectangular cover sections, each removable from a cover receiving apparatus, the first and second sections having respective generally linear first and second inner edges, the third section comprising a middle section having first and second outer edges, the first inner edge and first outer edge including means for releasably interlocking said first section with said middle section, and the second inner edge and second outer edge including means for releasably interlocking said second section with said middle section to form a generally rectangular cover having a periphery adapted to seat on a rim of the cover receiving apparatus and to be removed therefrom, each section being formed of molded plastic and having an inner skin substantially spaced apart from an outer skin.

15. The cover apparatus of claim 14 further including a plurality of intermediate zones in each of said first, second, and third cover sections where the inner skin is formed with impressions which terminate in contact with the outer skin.

16. The cover apparatus of claim 15 wherein the impressions comprise elongated ribs, the inner and outer skins contacting one another at one or more intervals along each rib.

17. The spa structure comprising:

a side wall having an upper rim; and a cover means mountable on said upper rim and having an elongated hinge projection formed on an edge thereof and contoured so as to form a trough therein, said trough positioned to extend over said rim so as to transfer water incident on said cover outside of said side wall.

18. Cover apparatus comprising:

a first molded cover section having a first inner edge;

a second molded cover section having a second inner edge;

a third molded cover section having first and second edges; and hinge means for pivotally interlocking said first inner edge with said first edge and said second inner edge with said second edge and for preventing horizontal disengagement of said first and second sections with respect to said third section while permitting disengagement of either of said first and second sections from said third section when one of said first and second sections is raised to an acute angle with the horizontal, while said third section remains horizontal;

wherein said hinge means comprises a first hinge structure and a second hinge structure, each of said first and second hinge structures comprising:

a male projection having, in cross-section, a bulbous portion undercut to form a recessed receptacle curving into a descending angled floor portion; and a female projection contoured to conform to the shape of said bulbous portion and to extend into and conform to the contour of said recessed receptacle and angled floor portion.

19. Cover apparatus comprising:

a first molded cover section having a first inner edge;

a second molded cover section having a second inner edge;

a third molded cover section having first and second edges; and hinge means for pivotally interlocking said first inner edge with said first edge and said second inner edge with said second edge and for preventing horizontal disengagement of said first and second sections with respect to said third section while permitting disengagement of either of said first and second sections from said third section when one of said first and second sections is raised to an acute angle with the horizontal, while said third section remains horizontal; and wherein said first inner edge includes a male hinge projection, a central finger, and first and second side fingers, and wherein said first edge includes female hinge means for interlocking with said male hinge projection and said first and second side fingers.

* * * * *